United States Patent [19]

McLellan et al.

[11] Patent Number: 4,879,145

[45] Date of Patent: Nov. 7, 1989

[54] MEMORIAL FLAG DISPLAY AND STORAGE CASE

[76] Inventors: Gordon McLellan, 32 Hawkins St.; Diane G. Wright, 1460 Elm St., B420, both of Stratford, Conn. 06497

[21] Appl. No.: 117,461

[22] Filed: Nov. 6, 1987

[51] Int. Cl.[4] ..... A47G 1/12; E06B 3/64

[52] U.S. Cl. ..... 428/14; D3/30.1; D6/470; 156/109; 206/216; 428/34.6; 428/542.4

[58] Field of Search ..... 428/13, 14, 542.4, 45, 428/46, 34.6; D3/30.1; 156/109; 116/174; 206/216; 40/152, 156, 604; D6/470

[56] References Cited

U.S. PATENT DOCUMENTS

| | | | |
|---|---|---|---|
| D. 248,507 | 7/1978 | Pivec | D3/30.1 |
| D. 267,686 | 1/1983 | Dawson | D3/30.1 X |
| 1,206,253 | 11/1916 | Roan | 428/13 X |
| 2,535,149 | 12/1950 | McBride | 206/216 |
| 2,654,451 | 10/1953 | Schmidgall | 428/14 X |
| 2,841,272 | 7/1958 | Dreier | 206/216 X |
| 3,500,789 | 3/1970 | Keats | 116/173 |
| 3,996,882 | 12/1976 | Martin et al. | 116/174 |
| 4,271,619 | 6/1981 | Schmidt | 40/155 X |

OTHER PUBLICATIONS

"We The People", Official Independence Hall Constitution Commemorative by the Franklin Mint, Franklin Center, PA., 19091, Brochure in File of Application, 1987.

*Primary Examiner*—Henry F. Epstein
*Attorney, Agent, or Firm*—John R. Doherty

[57] ABSTRACT

A display and storage case is provided for a memorial flag which is folded into the shape of an isosceles triangle according to military custom. The case includes two frame members, a base plate and a pair of transparent panels which hold the folded flag under compression so that the flag will not sag or unfold while maintained in the case.

7 Claims, 2 Drawing Sheets

FIG. 1
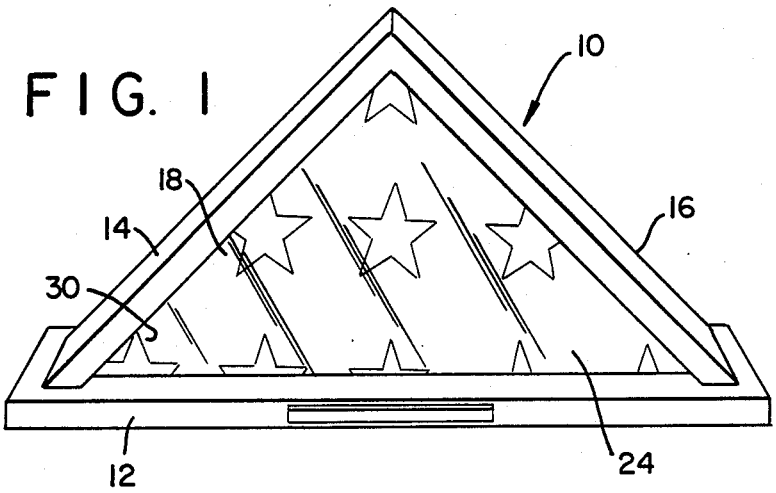
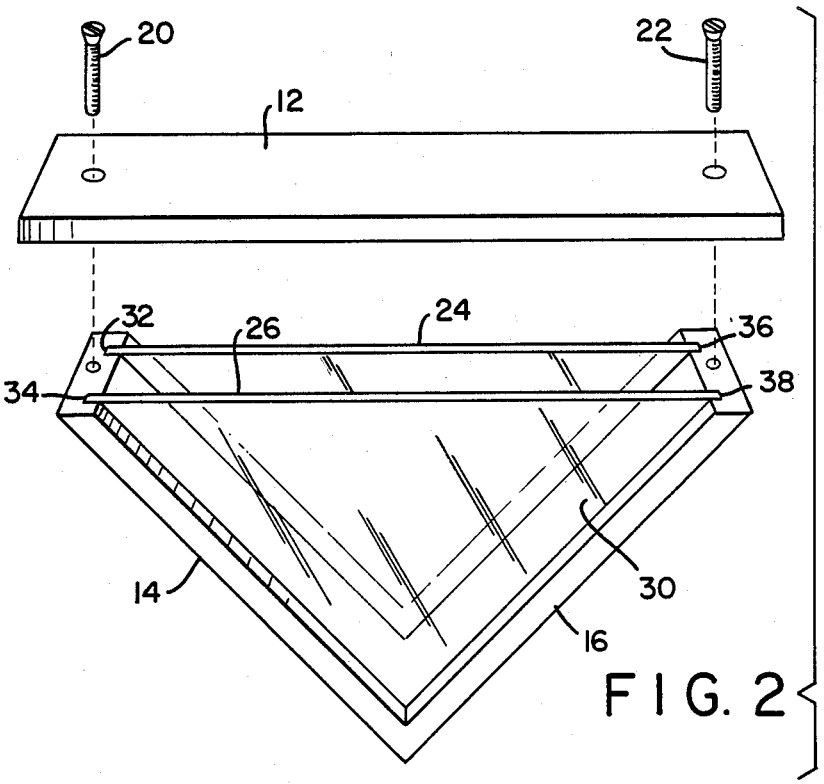
FIG. 2

MEMORIAL FLAG DISPLAY AND STORAGE CASE

This invention relates in general to display and storage cases and more particularly to a display and storage case for a folded memorial flag.

BACKGROUND OF THE INVENTION

Memorial flags of the United States are traditionally presented to the next of kin of deceased, honorably discharged, U.S. Armed Forces veterans or servicemen during funeral services held with military honor. These flags are normally quite large and are folded in proper military manner into the form of an isosceles triangle with the blue field and stars visible from both sides of the folded flag. In most cases, the flags are stored away in a chest or closet for lack of any suitable way to display the flags while yet protecting them against dust and damage by moths, moisture and the like.

It is therefore an important object of the invention to provide a display and storage case for a memorial flag.

Another object of the invention is to provide a display and storage case for a memorial flag which allows the flag to be displayed while still folded and which, at the same time, protects the flag against dust and damage by moths, moisture and the like.

Still another object of the invention is to provide a display and storage case for a memorial flag which holds the flag while folded in an upright position from whence the flag is most visible and yet which prohibits the flag from sagging or unfolding under its own weight while in the case.

BRIEF DESCRIPTION OF THE INVENTION

The foregoing and other related objects and advantages of the invention are achieved by a display and storage case for a memorial flag which has been folded into the shape of an isosceles triangle, which case comprises a base plate and two frame members joined together at one end and having their opposite ends mounted on the base plate. The two frame members are substantially equal in length and form together with the base plate an opening having the same triangular shape and size as that of the folded flag. A pair of substantially ridged, transparent panel members are mounted in spaced apart relation inside the opening formed by the two frame members and the base plate. However, the transparent panel members are made slightly larger than the opening on two adjacent sides so as to fit snugly within a pair of parallel slots formed on the inner side of each frame member and extending longitudinally along the opposite marginal edges thereof. The transparent panel members rest on the top surface of the base plate along the remaining or third side with the folded flag inserted between the two panel members. The distance between the two spaced apart, parallel, transparent panel members is less than the thickness of the folded flag so that the flag is always held under compression between the two panel members. Thus, the flag will not unfold or sag while held in the case.

DESCRIPTION OF THE DRAWING

In the accompanying drawing:

FIG. 1 is a perspective view of the memorial flag display and storage case of the invention;

FIG. 2 is a perspective, partially exploded view of the display and storage case shown in an inverted position during assembly.

DESCRIPTION OF THE PREFERRED EMBODIMENT

Figure 3:
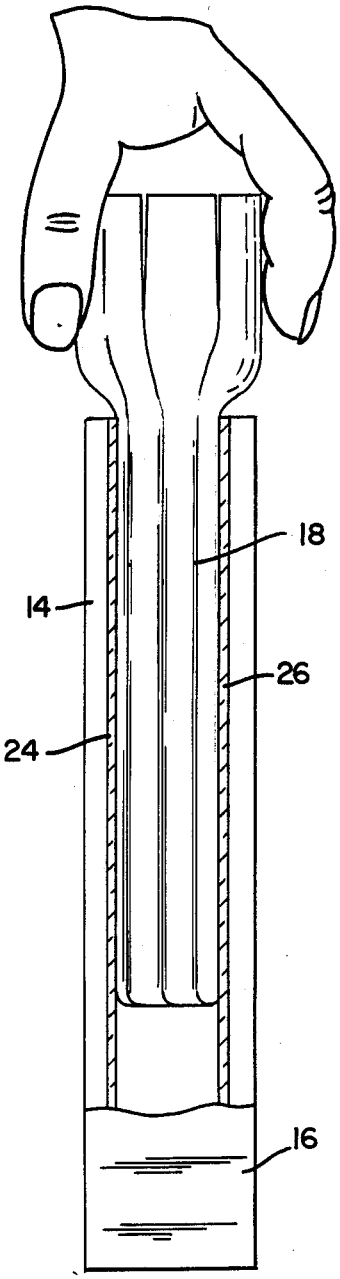
FIG. 3 is a side elevational view, partially in section, of the inverted display and storage case illustrated in FIG. 2, showing the folded memorial flag being inserted through the bottom of the case under compression between the two transparent panel members

Referring now to the drawing in detail, there is shown a memorial flag display and storage case 10 embodying the invention. As shown, the case 10 includes an elongated, flat, rectangular base plate 12 and two flat, rectangular frame members 14, 16. The two frame members 14, 16 are of substantially equal length and are joined together at one end to form two sides of an isosceles triangle which is the same shape an size as that of the folded memorial flag indicated at 18. The two opposite ends of the frame members 14, 16 rest on the top surface of the base plate 12 and are secured thereto by a pair of screws 20, 22 which pass through the underneath side of the plate. In the embodiment of the display and storage case illustrated, the base plate 12 is greater in width than the two frame members 14, 16 and slightly longer in length than the distance between the two opposite ends of the frame members 14, 16 which rest on the plate. The base plate 12 and the two frame members 14, 16 are preferably made of hard wood such as maple or natural oak, although other materials such as metals or plastics can also be used as will readily occur to those skilled in the art.

A pair of flat, substantially ridged, transparent panels 24, 26 are mounted one on each side of the display and storage case 10. The transparent panels 24, 26 are the same isosceles triangular shape as the opening 30 formed by the two frame members 14, 16 and the base plate 12 but are made slightly greater in width on the two sides facing the frame members 14, 16. These two sides of the panels 24, 26 fit snugly within two elongated spaced apart slots 32, 34 and 36, 38 provided on the underneath side of each of the two frame members 14, 16 as best shown in the view of FIG. 2. The slots 32 and 36 are formed longitudinally along the marginal edge portions of the frame members 14, 16, respectively, and support two sides of the front panel 24. In a similar manner, the slots 34 and 38 are formed longitudinally along the opposite marginal edge portions of the frame members 14, 16, respectively, and support two sides of the rear panel 26. The remaining or third side of each transparent panel 24, 26 rests under its own weight on the top surface of the base plate 12 in the position shown in FIG. 1. The pair of transparent panels 24, 26 may be made of glass or most any substantially ridged, transparent plastic material.

The display and storage case 10 is assembled by first placing the pair of transparent panels 24, 26 into the respective slots formed on the underneath side of each frame member 14, 16 in the manner as described hereinabove and with the base plate 12 removed. The folded flag 18 is then inserted through the bottom of the case 10 between the pair of spaced apart transparent panels 24, 26 as shown in FIG. 3, care being taken to properly orient the flag so that the stars are arranged in horizontal rows. Although the memorial flag which ordinarily measures about 5 ft. by 9½ ft., is folded as tightly as possible during the military ceremony, the folded flag is still rather loose and can be easily compressed by applying pressure against one or both of its sides. Accordingly, the distance between the pair of transparent panels 24, 26 is made to be less than the thickness of the folded flag in its uncompressed or normal condition. Preferably, the pair of transparent panels 24, 26 are spaced a sufficient distance apart from each other to compress the folded flag 18 approximately 20 to 25 percent of its original thickness prior to being inserted between the panels. After the folded flag 18 has been fully inserted between the pair of transparent panels 24, 26, the base plate 12 is positioned over the bottom of the case 10 and is secured in place by the screws 20, 22. The screws 20, 22 pass through the base plate 12 and engage holes at opposite ends of the frame members 14, 16. With this arrangement, it will be seen that the folded flag 18 will always be kept in an upright position without sagging or unfolding under its own weight while maintained in the case 10.

The invention thus provides a novel display and storage case for a memorial flag folded into an isosceles triangle according to military custom, which holds the folded flag in an upright, visible position without sagging or unfolding and which protects the flag against dust and damage. In particular, it should be noted that the arrangement of the slots which hold the pair of transparent panels exclude dust, moths and heavy moisture from contact with the enclosed flag. The weight of each panel against the top surface of the base plate also provides an effective barrier against ingress of these same elements.

What is claimed is:

1. In combination: a memorial flag folded into the shape of an isosceles triangle and a display and storage case therefor, said display and storage case comprising:

an elongated, flat base plate;

two elongated frame members joined together at one end and having their opposite ends mounted on said base plate, said frame members being of substantially equal length and forming together with said base plate an isosceles triangular shaped opening of a size which is substantially identical to that of said folded flag, the inner side wall of each frame member having a pair of elongated, spaced apart, parallel slots formed therein, each one of said slots extending longitudinally along a marginal edge of said frame member;

a pair of substantially rigid, transparent panel members having the same isosceles triangular shape as that of said opening and being of a size which is slightly larger than said opening on two adjacent sides thereof;

said transparent panel members being mounted within said triangular shaped opening with said folded flag therebetween and having each of said larger adjacent sides thereof fitting snugly within one of said pair elongated slots formed in said frame members;

the third side of each transparent panel member resting on said base plate;

the spacing between said pair of elongated slots in each frame member being such that said transparent panel members are separated by a distance which is substantially less than the normal thickness of said flag when loosely folded prior to assembly within said case so that said flag is held under compression between said transparent panel members and maintained in an upright position therebetween without sagging or unfolding under its own weight;

the compressed and folded flag acting as a bias member urging said transparent panel members into sealing engagement with said slots along the edges of said two adjacent sides thereof, prohibiting the ingress of dust, moths and other foreign materials; and means for removably securing the opposite ends of said frame members to said base plate.

2. The combination according to claim 1, wherein the pair of transparent panel members are spaced apart a sufficient distance from one another to compress the loosely folded flag approximately 20 to 25 percent of its thickness prior to assembly in the case.

3. The combination according to claim 1, wherein said means for removably securing said base plate comprises a pair of screws passing through the underneath side of said base plate.

4. The combination according to claim 1, wherein said base plate is wider than said two elongated frame members and slightly longer than the distance between the two opposite ends of said frame members.

5. The method of assembling a storage and display case for a memorial flag which has been folded loosely into the shape of an isosceles triangle, said display and storage case including an elongated flat base plate, two elongated frame members of substantially equal length joined together at one end and forming two sides of an isosceles triangle which is substantially identical to that of said folded flag, each of said frame members having a pair of spaced apart, parallel slots within the inner side wall thereof which extend longitudinally along one marginal edge of said frame member and a pair of substantially rigid, transparent panel members having the same isosceles triangular shape but having two adjacent sides which are slightly larger than the isosceles triangle formed by said frame members, the spacing between said pair of elongated slots in each frame member being less than the normal thickness of said flag when loosely folded prior to assembly within said case; said method comprising the steps of:

placing each one of said transparent panel members into one of said spaced apart, parallel slots formed along the marginal edge of each frame member providing therebetween an open space for storage of said loosely folded flag, said space being essentially the same size and shape as that of said flag but having a width which is substantially less than the thickness of said folded flag prior to storage;

inserting the loosely folded flag into said open space between said transparent panel members with said flag oriented to coincide with the shape of said opening;

forcing said loosely folded flag into said space so as to compress said flag therebetween until the compressed flag is fully retained between said panel members;

placing said base plate over the opening of said space; and securing said base plate to the opposite ends of said frame members.

6. The method according to claim 5, wherein the pair of elongated slots in each frame member are spaced apart a sufficient distance from one another to compress the loosely folded flag approximately 20 to 25 percent of its thickness prior to assembly in the case.

7. The method according to claim 5, wherein a pair of screws are passed through the underneath side of said base plate to secure the same to each frame member.

* * * * *